US010880645B2

(12) United States Patent
Wijnings et al.

(10) Patent No.: US 10,880,645 B2
(45) **Date of Patent: *Dec. 29, 2020**

(54) CALIBRATION OF MICROPHONE ARRAYS WITH AN UNCALIBRATED SOURCE

(71) Applicant: Sorama, Eindhoven (NL)

(72) Inventors: Patrick Wijnings, Eindhoven (NL); Rick Scholte, Eindhoven (NL)

(73) Assignee: Sorama B.V., Eindhoven (NL)

( * ) Notice: Subject to any disclaimer, the term of this patent is extended or adjusted under 35 U.S.C. 154(b) by 0 days.

This patent is subject to a terminal disclaimer.

(21) Appl. No.: 16/805,354

(22) Filed: Feb. 28, 2020

(65) Prior Publication Data

US 2020/0204912 A1 Jun. 25, 2020

Related U.S. Application Data

(63) Continuation of application No. 16/244,918, filed on Jan. 10, 2019, now Pat. No. 10,616,682.

(60) Provisional application No. 62/616,884, filed on Jan. 12, 2018.

(51) Int. Cl.

| | |
|---|---|
| ***H04R 3/00*** | (2006.01) |
| ***H04R 1/40*** | (2006.01) |
| *H04R 29/00* | (2006.01) |

(52) U.S. Cl.

CPC ..... *H04R 3/005* (2013.01); *H04R 1/406* (2013.01); *H04R 29/005* (2013.01); *H04R 2201/003* (2013.01); *H04R 2201/401* (2013.01); *H04R 2410/03* (2013.01)

(58) Field of Classification Search

CPC ..... H04R 1/406; H04R 2201/401; H04R 29/005; H04R 3/005; H04R 2201/003; H04R 2410/03

USPC ..... 381/58, 92, 97, 104, 120, 122, 150

See application file for complete search history.

(56) References Cited

FOREIGN PATENT DOCUMENTS

| | | |
|---|---|---|
| CN | 101668243 | 3/2010 |
| EP | 1453349 | 9/2004 |

OTHER PUBLICATIONS

Schulke, "Statistical physics of linear and bilinear inference problems", 2016, arXiv1607.00675v1.

*Primary Examiner* — Vivian C Chin
*Assistant Examiner* — Friedrich Fahnert
(74) *Attorney, Agent, or Firm* — Lumen Patent Firm

(57) ABSTRACT

Microphone array calibration that does not require a calibrated source or calibrated reference microphone is provided. We provide a statistical (Bayesian) algorithm that (under condition of reasonable environment noise during calibration) can determine gain and phase differences of a whole array at once, even when the gain and/or phase of the source is unknown. More specifically, a Bayesian regression with complex log-normal prior and complex normal likelihood is employed. The inherent phase-wrapping ambiguity in this regression is resolved by exploiting the similarity of likelihood between a lattice point and its Euclidean Voronoi region.

14 Claims, 9 Drawing Sheets

CALIBRATION OF MICROPHONE ARRAYS WITH AN UNCALIBRATED SOURCE

CROSS REFERENCE TO RELATED APPLICATIONS

This application is a continuation of Ser. No. 16/244,918 filed on Jan. 1, 20119 and hereby incorporated by reference in its entirety.

Application Ser. No. 16/244,918 claims the benefit of U.S. provisional patent application 62/616,884, filed on Jan. 12, 2018, and hereby incorporated by reference in its entirety.

FIELD OF THE INVENTION

This invention relates to improved calibration of microphone arrays, e.g. by providing calibration without any need for a calibrated source or calibrated reference sensor.

BACKGROUND

Over the past decades, noise pollution has become an increasing problem. To reduce noise emissions, it is imperative that engineers have easy access to sound measurement equipment so that acoustic product design can be improved. To this end, equipment such as a 1024 channel MEMS microphone array for near-field acoustical holography and far-field beamforming applications is commercially available.

To get good near-field acoustical holography and far-field beamforming results, it is important to compensate for differences between gain and phase deviations of the individual microphones. The goal of calibration is to reduce the uncertainty of these differences. Conventionally this calibration is done using a set of measurements with known source.

SUMMARY

However, we want customers to be able to calibrate their microphone array 'at home'/in their office, i.e. without access to expensive acoustic laboratory equipment such as a calibrated acoustic source. So our source is fully or partially unknown. This is an aspect not covered by existing microphone array calibration methods, to our knowledge. More generally, there is no need for any calibrated reference in our approach for providing calibration of arrays of acoustic microphones.

We provide a statistical (Bayesian) algorithm that (under condition of reasonable environment noise during calibration) can determine gain and phase differences of a whole array at once, even when the gain and/or phase of the source is unknown. This guarantees a compensated array will always outperform a (non-compensated) factory array. As part of this method, the phase-wrapping ambiguity is dealt with via a novel approach.

This is possible by taking into account the uncertainties in acoustic source, waveguide and the microphones (i.e. specification from the manufacturer or results from a prior calibration). Because there is a plurality of microphones, the (previously unknown) gain and phase of the single source can be estimated. These estimated properties can then in turn be used to calibrate the microphones. More technically, a presently preferred algorithm implements a Bayesian regression with complex log-normal prior and complex log-normal likelihood. The inherent phase-wrapping ambiguity in this regression is resolved by exploiting the similarity of likelihood between a lattice point and its Euclidean Voronoi region.

DETAILED DESCRIPTION

A) General Principles

Microphone array calibration is a topic of general interest: a well-calibrated array produces less disturbance, and reconstruction could be improved by accounting for any remaining calibration errors. Array calibration has been studied before in the contexts of radar and beamforming, but to the authors' knowledge no calibration method is available that:

1) can correct both gain and phase deviations of the sensors;
2) can guarantee a calibrated array will always outperform a (non-calibrated) factory array; and
3) does not require a precise reference signal (e.g. from an acoustic source or a reference sensor).

In this work we provide a novel calibration method with these properties in a Bayesian framework.

Figure 1:
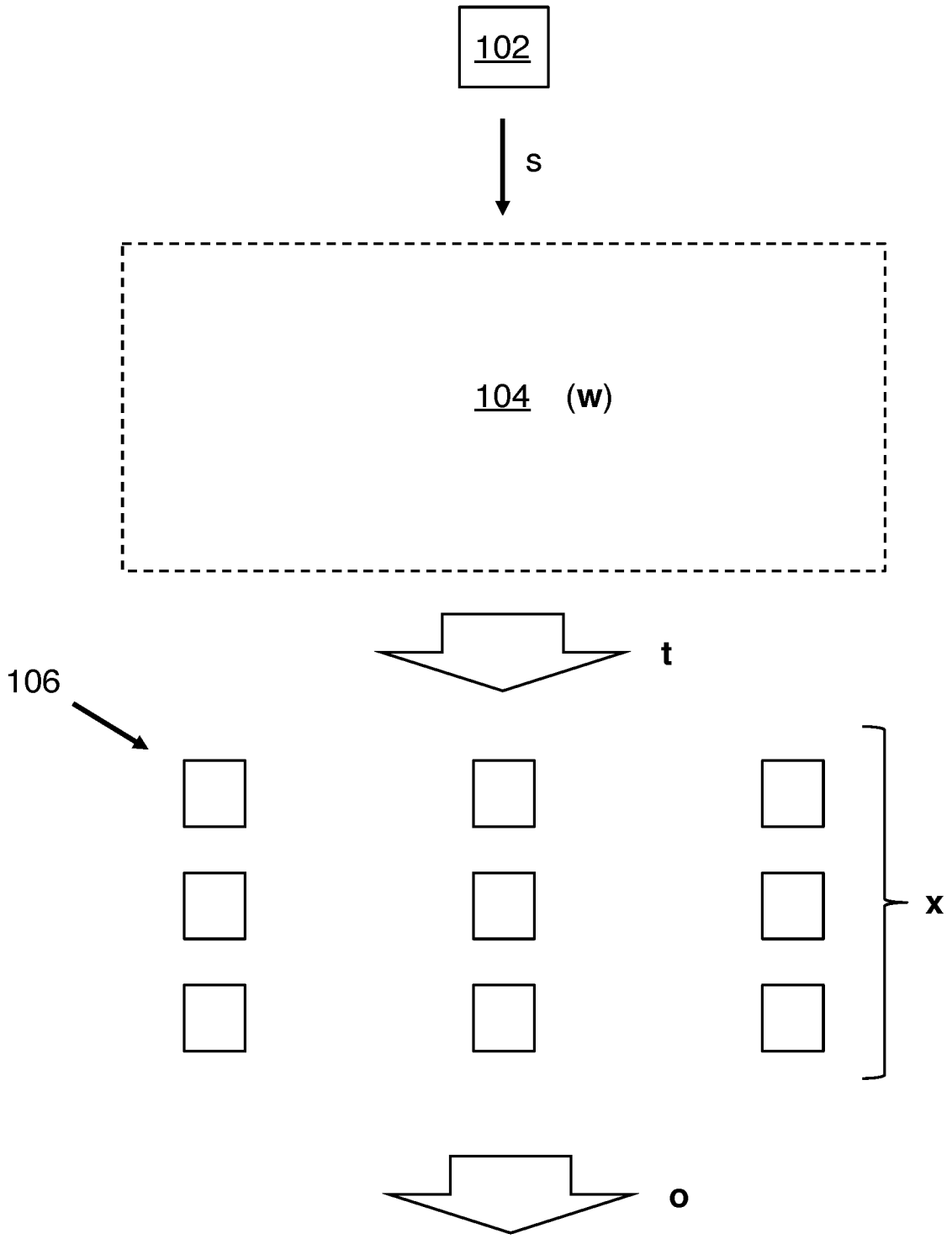
FIG. 1 schematically shows an acoustic microphone array calibration setup.

To begin, it will be helpful to consider a microphone array calibration setup as shown on FIG. 1. In this example, a single acoustic source 102 provides a source signal s to a transmission medium 104 having transfer function w from the source to each element of the microphone array 106. It is convenient to combine the source signal s and the transfer function w into a parameter t which is the input to array 106. Here boldface quantities denote N dimensional vectors where N is the number of elements in the microphone array. The measured output of the microphone array is the observation o. The quantity x accounts for the gain and phase variation of the elements of microphone array 106. Microphone array calibration amounts to providing an estimate for the gains and phases x based on the observation o and on the transfer function w. For Bayesian estimation, an estimate for x prior to calibration is also used.

Figure 2:
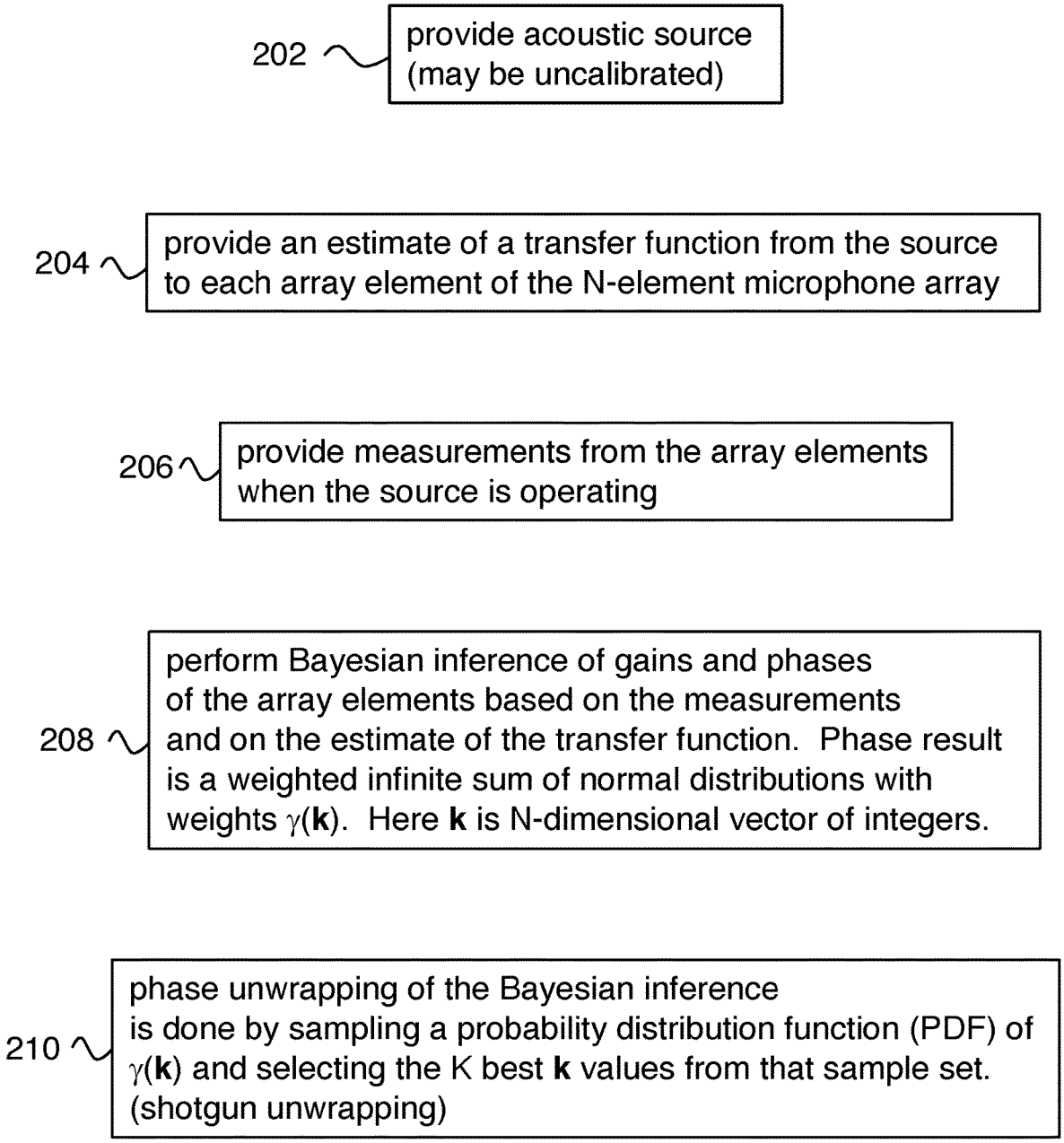
FIG. 2 show steps of a method for microphone array calibration according to an embodiment of the invention.

FIG. 2 shows steps of a method for microphone array calibration according to an embodiment of the invention. Step 202 is providing an acoustic source. Importantly, there is no requirement that this source be calibrated. Step 204 is providing an estimate of the transfer function (w) from the source to each array element of the N-element microphone array. As seen below, it will suffice for this estimate to be a probabilistic estimate. Step 206 is providing measurements (o) from the array elements when the source is operating. Step 208 is performing Bayesian inference of gains and phases (x) of the microphone array based on the measurements and on the estimate of the transfer function and on the estimate of prior x.

As used herein, Bayesian inference is defined as a method of statistical inference in which Bayes' rule (i.e., $P(A|B)=P(B|A)P(A)/P(B)$ where A and B are events) is used to find a (posterior to calibration) estimate of the gains and phases (x), based on beliefs from one or more (possibly uncertain) measurements, preferably constrained with an informative (i.e. sufficiently known to reduce uncertainty in the measurement(s)) belief about the gains and phases (prior to calibration). The beliefs are quantified as probability distributions. Thus, a quantitative method is obtained to reduce uncertainty in the measurements (e.g., a fully or partially unknown source, or deviations in the transmission medium, or noise) with informative prior beliefs, thus improving the quality of calibration over the situation where only the measurements (and not the prior beliefs) would have been used. This is especially relevant for array calibration, because the plurality of microphones amplifies the uncertainty-reducing effects of (possibly mild) prior beliefs about each single microphone and hence can significantly improve quality of the calibration. Note that if the measurements are not constrained with prior beliefs, or the prior beliefs are not informative, at least some certainty about the measurements (e.g. source and waveguide) must be provided to obtain usable calibration results. However, in the context of array calibration, sufficient prior beliefs are typically readily available in practice, e.g. from specifications of the microphone manufacturer. The following description provides an illustrative detailed example of a presently preferred approach for such Bayesian inference as applied to microphone array calibration.

In this example, the result for gain is a normal distribution and the result for phase is an infinite weighted sum of normal distributions with weights $\gamma(k)$. Here k is an N-dimensional vector of integers. Step 210 is phase unwrapping (i.e., truncating the infinite sum to a finite sum) by sampling a probability distribution function (PDF) of $\gamma(k)$ and selecting the K best k values from that sample set. This approach for phase unwrapping is called shotgun unwrapping.

Figure 3:
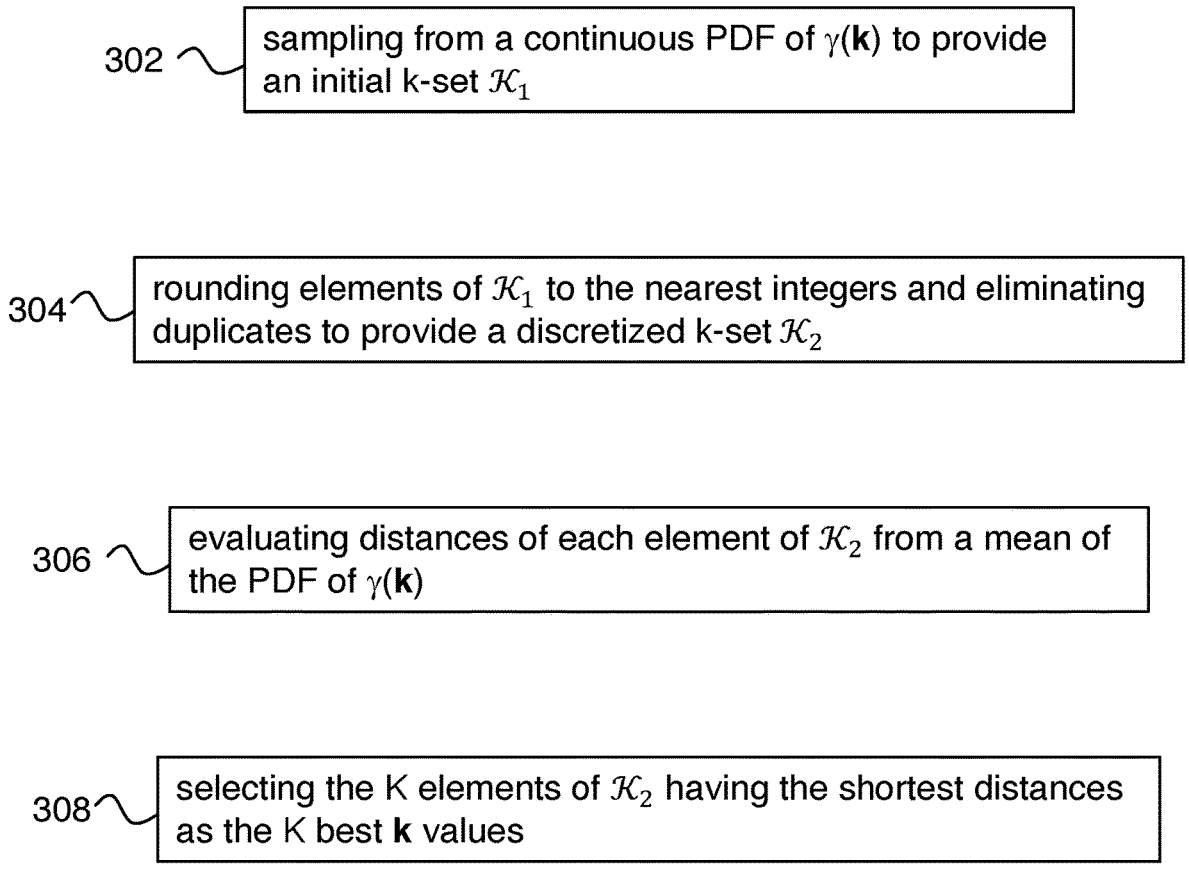
FIG. 3 shows steps of a phase unwrapping method suitable for use in embodiments of the invention.

FIG. 3 shows steps of a phase unwrapping method suitable for use in embodiments of the invention. This method shows the sub-parts of step 210 on FIG. 2 in greater detail. Here step 302 is sampling from a continuous PDF of $\gamma(k)$ to provide an initial k-set $\mathcal{K}_1$. This can readily be done, since as seen below $\gamma(k)$ is normally distributed with known mean and covariance matrix. Thus standard statistical methods can efficiently provide this sampling. Step 304 is to round the elements of $\mathcal{K}_1$ to the nearest integers (more precisely, to the nearest lattice points in N-dimensional space) and eliminate any resulting duplicates to provide a discretized k-set $\mathcal{K}_2$. Step 306 is to evaluate the distance (using an appropriate metric as shown in detail below) between each element of $\mathcal{K}_2$ and the mean of the PDF of $\gamma(k)$. Smaller distances correspond to more likely weights. Thus step 308 is to select the K elements of $\mathcal{K}_2$ having the shortest distances as the K best k values. Here K is a predetermined integer that can be selected based on practical considerations. K is limited by computational resources (i.e. larger K results in more memory requirements and longer runtime). Also, there is no need to make K larger than the amount of elements remaining in $\mathcal{K}_2$. In some situations encountered in practice, the amount of remaining points in $\mathcal{K}_2$ is already quite small, which makes selection of K trivial.

Selecting the K smallest distances from $\mathcal{K}_2$ can be expedited according to known principles, such as removing elements of $\mathcal{K}_2$ having distances greater than a predetermined threshold prior to selecting the K best weights. This is helpful since sorting $\mathcal{K}_2$ is typically done as part of selecting the K smallest distances from $\mathcal{K}_2$, and the sorting will take less time if the k values having distances that are way too high are removed first. In preferred embodiments, the distances are computed as follows. Let the probability distribution of $\gamma(k)$ have a mean $\mu_u$ and a covariance matrix $\Sigma_\mu$. Then the distances M(k) are given by $M(k)=\sqrt{(k-\mu_u)^H\Sigma_u^{-1}(k-\mu_u)}$.

Figure 4A:
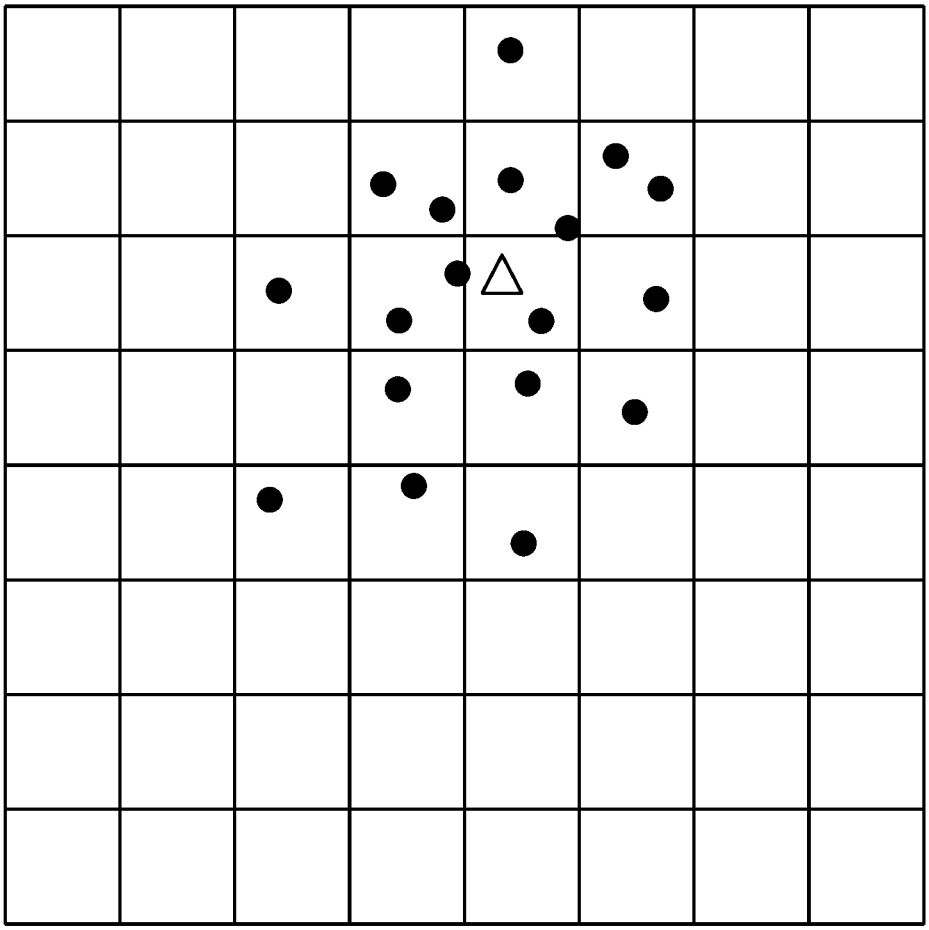
FIGS. 4A-D are sketches corresponding to the steps of the method of FIG. 3.
Figure 4B:
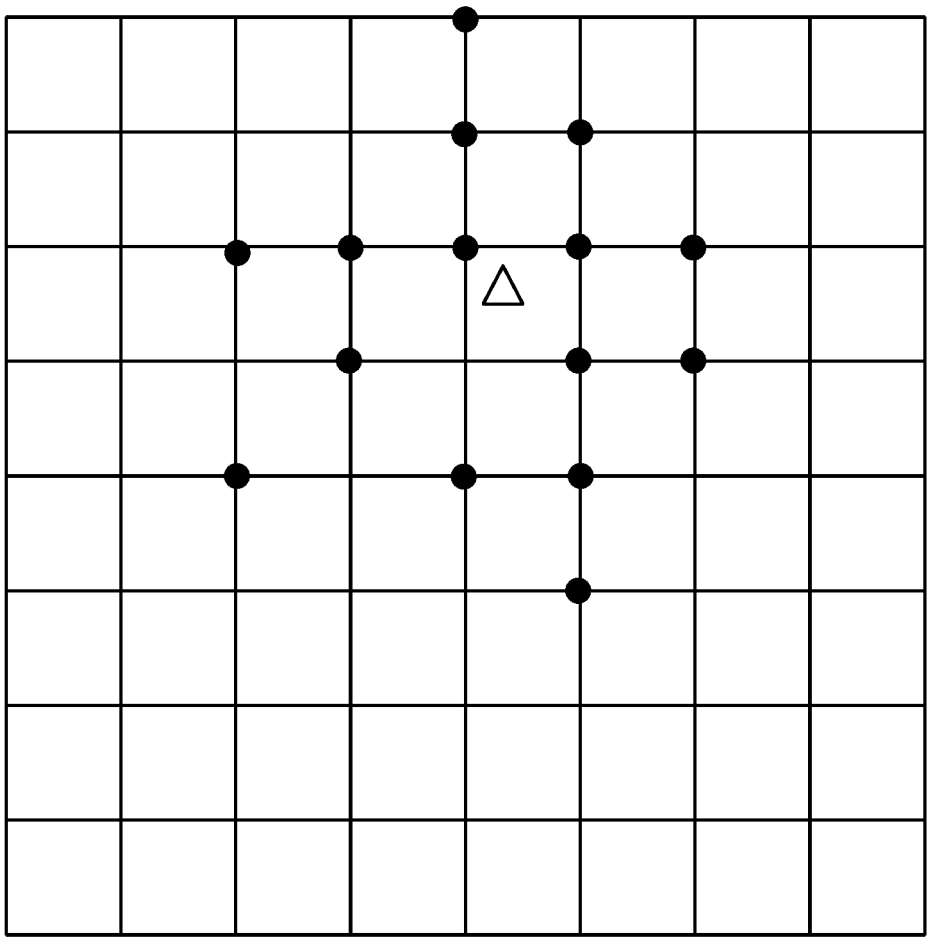
Figure 4C:
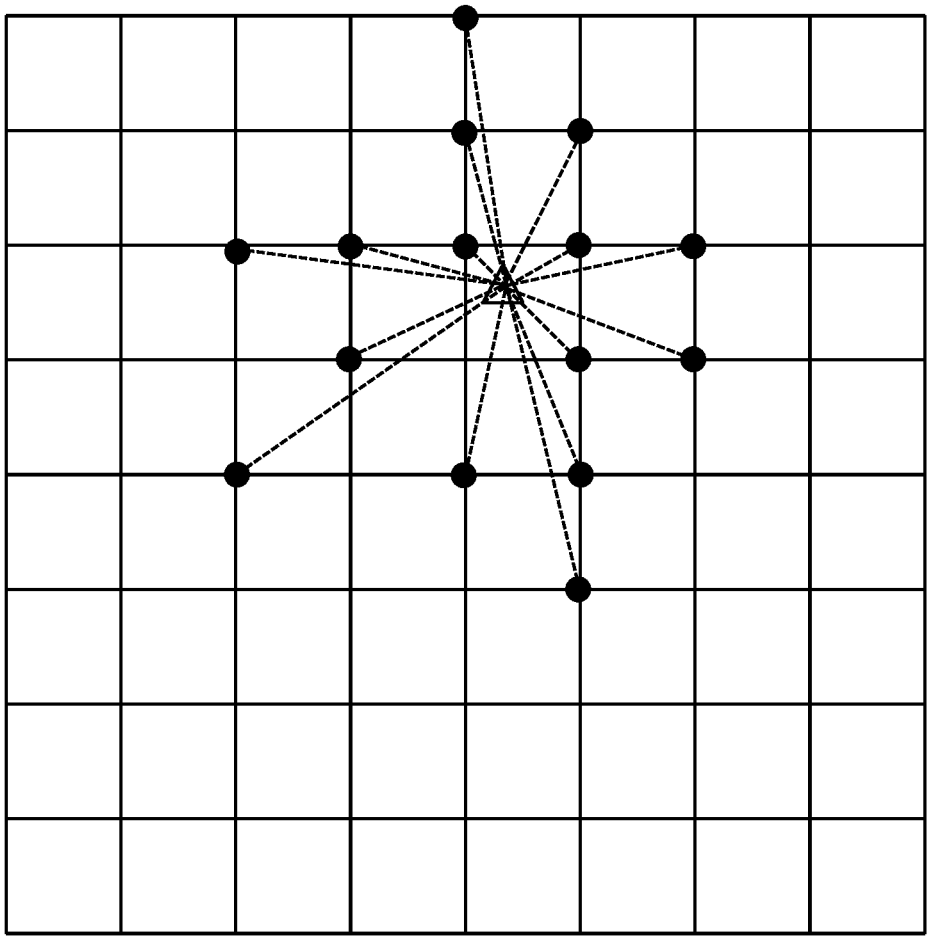
Figure 4D:
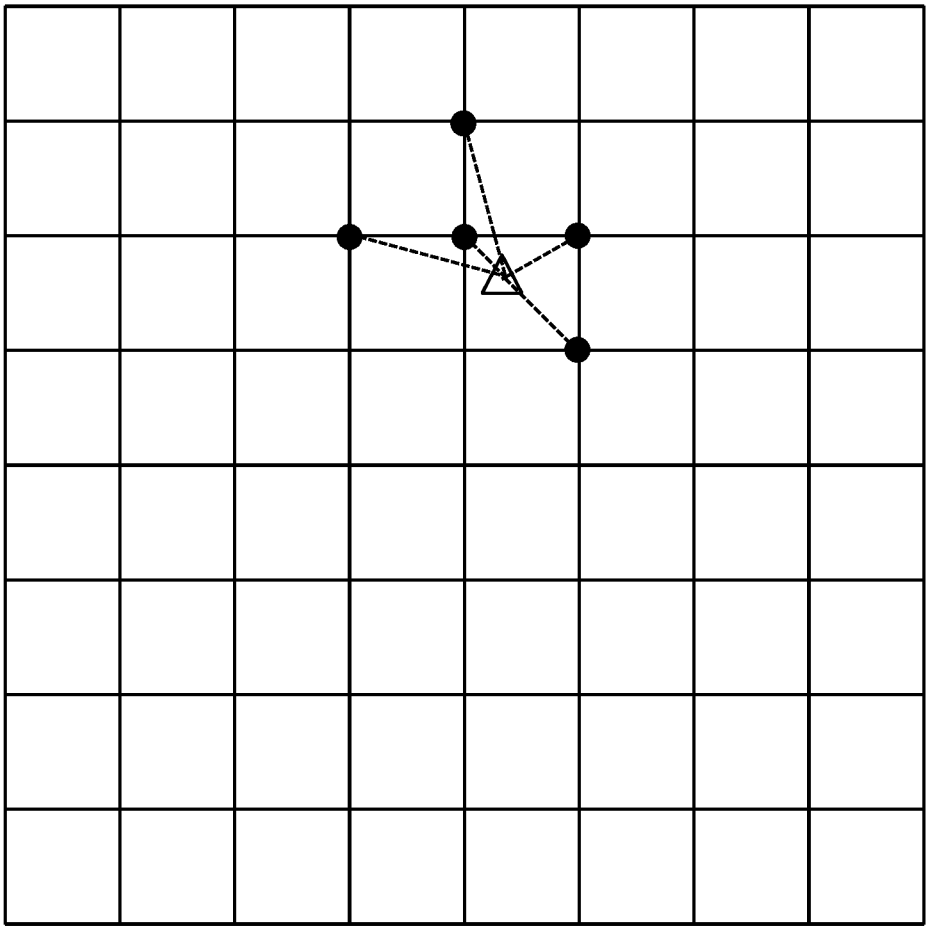

FIGS. 4A-D are sketches corresponding to the steps of the method of FIG. 3. Here FIG. 4A corresponds to step 302, where the sample points are black disks and the mean of $\gamma(k)$ is an open triangle. FIG. 4B shows the result of step 304. Note that sample points are now only present at lattice points (i.e., intersections of the grid lines). FIG. 4C shows the result of step 306. Every sample point has its distance to the mean (dashed line) calculated. FIG. 4D shows the result of step 308. Only the K sample points closest to the mean are retained (here K=5 to provide a simple example). Note that it is possible (as seen on FIG. 4D) for a nearby lattice point to be missed by this method, but probabilistically it provides good results.

Although the example of FIGS. 4A-D appears to be trivial, since there are much simpler and more direct methods to find lattice points close to the triangle on these figures, that is an erroneous impression caused by this example having N=2 for ease of illustration. As indicated below, finding these closest lattice points is NP-hard in the number of dimensions N. Since relevant acoustic microphone arrays can have hundreds of elements or more, it is important to have a phase unwrapping approach that scales well to high dimensionality.

As indicated above, an important advantage of this approach is that the source doesn't need to be calibrated. The amplitude and phase of the acoustic source can be assumed to be drawn from a predetermined source probability distribution. Such a source probability distribution can be significantly ill-defined (e.g., unknown phase, amplitude range=dynamic range of the source) without significantly impairing the calibration. This allows one to calibrate an acoustic microphone array with readily available sources, such as the speaker of a smart phone, or more generally from any mobile electronic device having a speaker. Examples include: An acoustic calibrator (or pistonphone) with known gain and frequency but unknown phase. A smart phone or computer loudspeaker with unknown gain, unknown phase, and possibly unknown/unstable frequency.

Practice of the invention does not depend critically on the details of transmission medium 104 on FIG. 1. As indicated below, this transmission medium can even be free space (preferably in an anechoic room). In some cases it is preferred to provide greater control over the transfer function w by providing an acoustic waveguide network configured to couple the acoustic source to the array of acoustic microphones. The acoustic waveguide network can include a source port (e.g., 508 on FIG. 5A) corresponding to the acoustic source, and array ports (e.g., 510 on FIG. 5A), each array port corresponding to a corresponding one of the elements of the array of acoustic microphones.

Figure 5A:
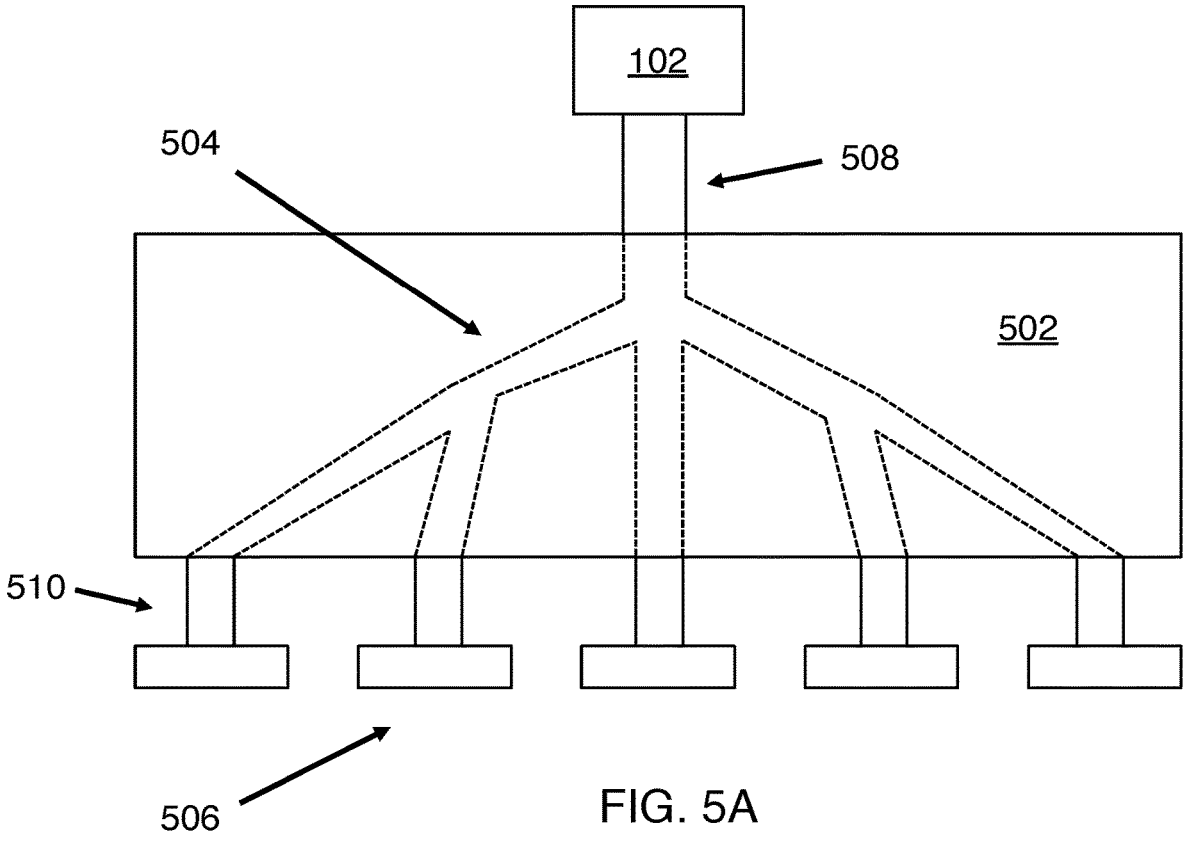
FIG. 5A shows a first exemplary acoustic waveguide configuration.
Figure 5B:
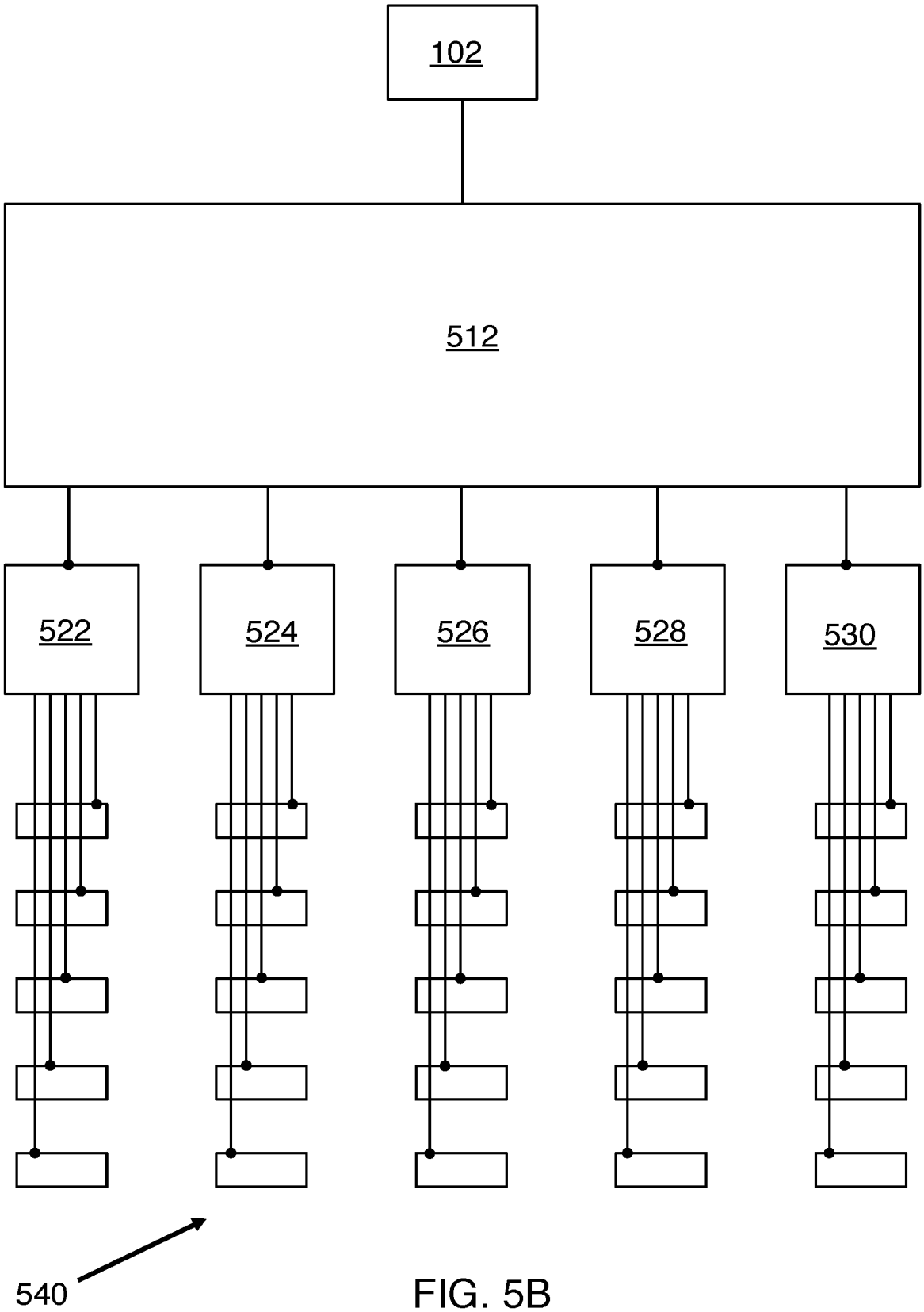
FIG. 5B shows a second exemplary acoustic waveguide configuration.

FIG. 5A shows a first exemplary acoustic waveguide configuration. In this example, acoustic source 102 is coupled to 1-D microphone array 506 via acoustic waveguide network 502. Acoustic waveguide network 502 can be implemented as a tree-like network of tubes 504. This amounts to a 1×5 acoustic splitter. Here 508 is the source port and 510 are the array ports of the acoustic waveguide network. FIG. 5B shows a second exemplary acoustic waveguide configuration. Here a 2-D array of microphones 540 is coupled to acoustic source 102 via an acoustic waveguide network including 1×5 acoustic splitters 512, 522, 524, 526, 528, 530. For simplicity of illustration, coupling is shown on FIG. 5B with single lines, and lines that cross an element of array 540 aren't coupled to that element.

Acoustic waveguide networks can be fabricated via rapid prototyping (e.g., 3D printing). An advantage of 3D printing is that customers with access to a 3D printer could download their own waveguide design and fabricate it on-site without a manufacturer needing to stock and ship it to them.

Optionally, a calibrated reference microphone (e.g. IEC 61672 sound pressure level meter) can be used to improve the calibration. When this microphone has tighter manufacturing/calibration tolerances than the microphones in the array, the calibration results can be further improved. Because this calibrated microphone is allowed in formal sound pressure level measurements (e.g. as evidence in a lawsuit), incorporating such an 'official' microphone in the calibration allows users to make measurements from our microphone array more accepted/traceable for formal purposes. Such a calibrated reference microphone can be expensive and hence not always available 'at home'. The main advantage of the present approach is that, unlike many existing methods, the reference microphone is not necessary for the calibration procedure to succeed.

B) Mathematical Development

Notation and variables are defined in the tables at the end of this section.

B1) Definitions

B1a) Complex Normal Distribution

If a is a complex normal random variable, then:

$$a \sim \mathcal{CN}\ (a;\ \mu_a,\ \Sigma_a) = \pi^{-N} \det(\Sigma_a)^{-1} \exp(-\|a-\mu_a\|_{\Sigma_a}^2), \tag{1}$$

where:

$$\|a-\mu_a\|_{\Sigma_a}^2 \overset{\text{def}}{=} (a-\mu_a)^H \Sigma_a^{-1} (a-\mu_a) \tag{2}$$

is the squared Mahalanobis distance.

B1b) Complex Log-Normal Distribution

If:

$$a \sim \mathcal{N}\ (a;\ \mu_a,\ \Sigma_a) \text{ and } b \sim \mathcal{N}\ (b;\ \mu_b,\ \Sigma_b), \tag{3}$$

then c is a complex log-normal variable:

$$c = \exp(a+ib) \sim \mathcal{CLN}\ (c;\ \mu_a + i\mu_b,\ \Sigma_a + i\Sigma_b). \tag{4}$$

B2) Algorithm Derivation

For measurements over a frequency range, the observation can be transformed to the frequency domain and the steps below can be performed for each frequency bin of interest.

Step a

Model the observation as a multivariate complex normal distribution:

$$o|s,\ w,\ x \sim \mathcal{CN}\ (o;\ s \cdot w \odot x,\ \sigma^2 I) \tag{5}$$

The location parameters (i.e. means) are set to the expected sound level of the source times the transfer functions (from source to each sensor) of the waveguide. The scale parameters (i.e. covariance matrix) account for measurement noise (e.g. sensor noise). The sensor noise floor is assumed to be a mix of many independent causes and hence normal by the central limit theorem. In the phasor domain, this manifests as a circularly-symmetric complex normal distribution as given above. Unfortunately sensor noise floor is typically specified in dB(A), which means only an upper bound is known for each frequency. In our model the noise is assumed to be generated after conversion from acoustical to the electrical domain.

Step b

Convert the model from the previous step to a multivariate complex log-normal distribution:

Gain Approximation:

$$\mu_m \overset{\text{def}}{=} \sqrt{1+\sigma^2} \tag{6}$$

$$\mu_g \overset{def}{=} \frac{\sigma^2}{2\mu_m^2} - \log\mu_m + \log|s \cdot w \odot x| \tag{7}$$

$$\sigma_g \overset{def}{=} \frac{\sigma}{\mu_m} \tag{8}$$

$$\log|o||s,\ w,\ x \sim \mathcal{N}\ (\log|o|;\ \mu_g,\ \sigma_g^2 I) \tag{9}$$

For phase:

$$\sigma_p \overset{\text{def}}{=} \sigma \tag{10}$$

$$\angle o|s,\ w,\ x \sim \mathcal{N}\ (\angle o;\ \angle[s \cdot w \odot x],\ \sigma_p^2 I) \tag{11}$$

Combining Gain and Phase Gives:

$$o|s,\ w,\ x \sim \mathcal{CLN}\ (o;\ \mu_g + i\angle[s \cdot w[x],\ [\sigma_g^2 + i\sigma_p^2]I) \tag{12}$$

The approximations of step b are accurate when the signal to noise ratio of the observation is 7 dB or better.

Step c

Model the uncertainties in the source signal and waveguide transfer function as another multivariate complex log-normal distribution.

Source Signal:

$$s \sim \mathcal{CLN}\ (s;\ \mu_s,\ \Sigma_s) \tag{13}$$

Waveguide Transfer Function:

$$w \sim \mathcal{CLN}\ (w;\ \mu_w;\ \Sigma_w) \tag{14}$$

Combined Distribution:

$$\mu_t \overset{\text{def}}{=} \mu_s + \mu_w \tag{15}$$

$$\Sigma_t \overset{\text{def}}{=} \Sigma_s + \Sigma_w \tag{16}$$

$$t \overset{\text{def}}{=} s \cdot w \sim \mathcal{CLN}\ (t;\ \mu_t,\ \Sigma_t) \tag{17}$$

A suitable waveguide/transmission medium has strong correlations between the paths from source to each of the sensors in the waveguide. This amounts to the requirement that any undesired deviations in the behavior of the waveguide, for example as caused by environmental factors such as temperature or the operator who is performing the measurement, should apply equally to each path in the transfer function w. When a suitable waveguide is used, assumptions about the test source can be (very) mild. In the simplest case, the waveguide is the free field, e.g. when positioning the source and microphone array at known positions in an anechoic room. When such a controlled environment is not available, it can be advantageous to couple the source more tightly to the array using a waveguide.

In practice this distribution often has location parameter set to zero, and scale based on the assumptions about source and waveguide. The scale parameters also encode the strong correlations that are typically present in a suitable waveguide. Unknown properties (e.g. the phase of the source) can be modelled as infinite (or in a practical implementation: very large) scale parameters. It is assumed that the gain and phase uncertainties here are independent. For example, a lack of information can be incorporated in the model as follows. For the phase, set the mean to 0 and the variance to π or more. This causes the prior on the source phase to become approximately uniform due to the tails of the normal distribution of phase wrapping around in the corresponding exponential. For the gain, the mean and variance can be set so that the prior covers the full dynamic range of the source.

Step d

Multiply the distributions of (b) and (c), then integrate out the nuisance variable t. This produces the multivariate complex log-normal likelihood distribution:

$$p(o, t|x)=p(o|t, x)p(t) \tag{18}$$

$$p(o|x)=\int p(o, t|x)dt \tag{19}$$

It is easiest to do this for the gain and phase parts separately. For the gain:

$$\begin{aligned} p(\log|o|, \log|t| \mid x) &= p(\log|o| \mid \log|t|, x)\cdot p(\log|t|) \\ &= \mathcal{N}(\log|o|; \mu_g, \sigma_g^2 I)\cdot\mathcal{N}\left(\log|t|; \Re\mu_t, \Re\sum_t\right) \\ &= \mathcal{N}\left(\log|o|; \frac{\sigma^2}{2\mu_m^2} - \log\mu_m + \log|x| + \Re\mu_t, \sigma_g^2 I + \Re\sum_t\right)\cdot \\ &\quad \mathcal{N}(\log|t|; \ldots), \end{aligned} \tag{20}$$

Where the last equality follows by considering both factors as functions of log|t| and applying known results. Because log|t| does not appear in the first factor, integrating it out is trivial:

$$\begin{aligned} p(\log|o| \mid x) &= \int p(\log|o|, \log|t| \mid x)dt = \\ &\quad \mathcal{N}\left(\log|o|; \frac{\sigma^2}{2\mu_m^2} - \log\mu_m + \log|x| + \Re\mu_t, \sigma_g^2 I + \Re\sum_t\right). \end{aligned} \tag{21}$$

Similarly, for the phase:

$$p(\angle o|x)=\mathcal{N}(\angle o; \angle x+\Im\mu_t, \sigma_p^2 I+\Im\Sigma_t) \tag{22}$$

Combining:

$$\mu_l \stackrel{def}{=} \frac{\sigma^2}{2\mu_m^2} - \log\mu_m + \log|x| + i\angle x + \mu_t \tag{23}$$

$$\sum_l \stackrel{def}{=} (\sigma_g^2 + i\sigma_p^2)I + \sum_t \tag{24}$$

$$o \,\Big|\, x \sim \mathcal{CLN}\left(o; \mu_l, \sum_l\right) \tag{25}$$

Step e

Model the prior sensor calibration state, again as a multivariate complex log-normal distribution:

$$x \sim \mathcal{CLN}(x; \mu_x, \Sigma_x) \tag{26}$$

The location parameters of this distribution are set to the nominal sensor sensitivity and phase offset. The scale parameters are based on the tolerances in sensor sensitivity and phase offset. Again, unknown tolerances can be modelled as infinite (or in a practical implementation: very large) scale parameters. It is assumed that the gain and phase tolerances of the sensors are independent.

Step f

Bayes' rule is applied to get the posterior:

$$x|o \sim \mathcal{CLN}(o; \mu_1, \Sigma_1)\,\mathcal{CLN}(x; \mu_x\Sigma_x)/Z, \tag{27}$$

where Z is a normalization constant. The likelihood (d) and prior (e) distributions can now be separated into real and imaginary parts (due to the circularly-symmetric property (under (a)) and the independence property (under (c) and (e)). These parts correspond to the gain and phase of the sensor, respectively. The gain and phase parts are processed separately.

Gain $$\begin{aligned} p(\log|x| \mid \log|o|) &= \mathcal{N}\left(\log|o|; \Re\mu_l, \Re\sum_l\right)\mathcal{N}\left(\log|x| \mid \Re\mu_x, \Re\sum_x\right)\Big/ Z_1 \\ &= \mathcal{N}\left(\log|x|; -\frac{\sigma^2}{2\mu_m^2} + \log\mu_m + \log|o| - \Re\mu_t, \Re\sum_l\right) \\ &\quad \mathcal{N}\left(\log|x| \mid \Re\mu_x, \Re\sum_x\right)\Big/ Z_1 \\ &= \mathcal{N}\left(\log|x|; \Re\mu_c, \Re\sum_c\right), \end{aligned} \tag{28}$$

where $\Re\mu_c$ and $\Re\Sigma_c$ follow from the Wiener filter:

$$\Re\sum_c \stackrel{def}{=} \left[\left(\Re\sum_l\right)^{-1} + \left(\Re\sum_x\right)^{-1}\right]^{-1}, \tag{29}$$

$$\Re\mu_c \stackrel{def}{=} \left(\Re\sum_c\right)\left[\left(\Re\sum_l\right)^{-1}\left(-\frac{\sigma^2}{2\mu_m^2} + \log\mu_m + \log|o| - \Re\mu_t\right) + \left(\Re\sum_x\right)^{-1}(\Re\mu_x)\right]. \tag{30}$$

Phase

Similarly, for the phase:

$$\begin{aligned} p(\angle x \mid \angle o) &= \mathcal{N}\left(\angle o; \Im\mu_l, \Im\sum_l\right)\mathcal{N}\left(\angle x \mid \Im\mu_x, \Im\sum_x\right)\Big/ Z_2 \\ &= \mathcal{N}\left(\angle x; \angle o - \Im\mu_t, \Im\sum_l\right)\mathcal{N}\left(\angle x \mid \Im\mu_x, \Im\sum_x\right)\Big/ Z_2 \\ &= \gamma(\angle o)\mathcal{N}\left(\angle x; \Im\mu_c, \Im\sum_c\right)\Big/ Z_2, \end{aligned} \tag{31}$$

where $\Im\mu_c$ and $\Im\Sigma_c$ again follow from the Wiener filter:

$$\Im\Sigma_c \stackrel{def}{=} [(\Im\Sigma_1)^{-1} + (\Im\Sigma_x)^{-1}]^{-1}, \tag{32}$$

$$\Im\bar{\mu}_c = (\Im\Sigma_c)[(\Im\Sigma_1)^{-1}(\angle o - \Im\mu_t) + (\Im\Sigma_x)^{-1}(\Im\mu_x)], \tag{33}$$

$$\gamma(\angle o) \stackrel{def}{=} \mathcal{N}(\angle o; \Im\mu_t + \Im\mu_x, \Im\Sigma_1 + \Im\Sigma_x). \tag{34}$$

The normalization constant $\gamma/Z_2$ has been retained explicitly, because a complication arises: the (unwrapped) angle $\angle o$ is unobservable and must hence be replaced with the (measured) angle $\measuredangle o+2\pi k$, where k denotes the phase ambiguity. Hence:

$$p(\angle x \mid \angle o) = \frac{1}{Z_3}\sum_{k\in\mathbb{Z}^N} \gamma(\angle o + 2\pi k)\mathcal{N}\left(\angle x; \Im\bar{\mu}_c(\angle o + 2\pi k), \Im\sum_c\right). \tag{35}$$

Note that $\Im\bar{\mu}_c$ now depends on the phase ambiguity k.

This expression can be interpreted as an infinite weighted mixture of Wiener filters (or an infinite weighted sum of normal distributions). For any practical implementation, it is required to truncate this infinite mixture and keep only the terms with dominant weights.

Unfortunately, selecting these terms amounts to the NP-hard Closest Lattice Vector problem. Moreover, existing heuristic methods, e.g. as described by Morelande in (IEEE Conference on Acoustics, Speech and Signal Processing, 2008, pp3441-3444), do not cope well with the strong correlations encoded in step (c). Therefore, we introduce a novel selection algorithm called shotgun unwrapping. The result of applying shotgun unwrapping (described in detail below) to truncate the summation and keep only the terms for which $\gamma$ is significant is a pruned set $\hat{k}\in\mathcal{K}$.

Finally, the posterior calibration mean and covariance are extracted by summarizing the mixture distribution (using expected value identities):

$$\Im\mu_c \stackrel{\text{def}}{=} \sum_{\hat{k}\in\mathcal{K}}\gamma(\measuredangle o+2\pi\hat{k})\,\Im\bar{\mu}_c(\measuredangle o+2\pi\hat{k})/\sum_{\hat{k}\in\mathcal{K}}\gamma(\measuredangle o+2\pi\hat{k}) \tag{36}$$

$$\Im\Sigma_c \stackrel{\text{def}}{=} \Im\bar{\Sigma}_c+\sum_{\hat{k}\in\mathcal{K}}\gamma(\measuredangle o+2\pi\hat{k})[\Im\bar{\mu}_c(\sum_{\hat{k}\in\mathcal{K}} o+2\pi\hat{k})]^2/\sum_{\hat{k}\in\mathcal{K}}\gamma(\measuredangle o+2\pi\hat{k})-\Im\mu_c^2 \tag{37}$$

Alternatively, the posterior mean and covariance can be evaluated for the circular variable $$\exp i\angle x|o. \tag{38}$$

This can give better results in practice, but has more complicated 'circular moment' expressions. For the circular mean:

$$\Im\mu_{c,circular} \stackrel{\text{def}}{=} \angle\{\sum_{\hat{k}\in\mathcal{K}}\gamma(\measuredangle o+2\pi\hat{k})\exp[i\,\Im\bar{\mu}_c(\measuredangle o+2\pi\hat{k})]\} \tag{38a}$$

A full circular covariance matrix could be constructed using circular correlation coefficients, but in practice the circular standard deviations of the individual microphones are sufficient to provide error bars on the calibration:

$$\sigma_{c,circular} \stackrel{\text{def}}{=} \sqrt{-2\ln\left|\sum_{\hat{k}\in\mathcal{K}}\gamma(\measuredangle o+2\pi\hat{k})\exp\left[i\mathcal{J}\bar{\mu}_c(\measuredangle o+2\pi\hat{k})-\frac{1}{2}\operatorname{diag}\mathcal{J}\sum_c\right]\Big/\sum_{\hat{k}=\mathcal{K}}\gamma(\measuredangle o+2\pi\hat{k})\right|} \tag{38b}$$

Shotgun Unwrapping

An expression for the weights as function of the summation index can be derived as follows:

$$\begin{aligned}\gamma(k) &= \mathcal{N}\left(\measuredangle o+2\pi k;\mathcal{J}\mu_t+\mathcal{J}\mu_x,\mathcal{J}\sum_l+\mathcal{J}\sum_x\right)\\ &= \mathcal{N}\left(2\pi k;\mathcal{J}\mu_t+\mathcal{J}\mu_x-\measuredangle o,\mathcal{J}\sum_l+\mathcal{J}\sum_x\right)\\ &= \mathcal{N}\left(k;\frac{\mathcal{J}\mu_t+\mathcal{J}\mu_x-\measuredangle o}{2\pi},\frac{\mathcal{J}\sum_l+\mathcal{J}\sum_x}{4\pi^2}\right)\\ &\stackrel{\text{def}}{=} \mathcal{N}\left(k;\mu_u,\sum_u\right)\end{aligned}$$

A large amount of points ('pellets') is drawn from the (continuous) random variable:

$$k_1\sim\mathcal{N}(k_1;\mu_u,\Sigma_u), \tag{40}$$

which are denoted by the set $\mathcal{K}_1$ of size $K_1$. This can be done efficiently by first sampling from a standard multivariate normal distribution and then coloring and adding the mean.

The pellets are rounded to their nearest integer value and duplicates are removed. Each pellet now corresponds to a discrete value of k. Denote this as the set $\mathcal{K}_2$ of size $K_2$.

Finally, the pellets are pruned by removing those with small weights. This can be done by sorting the pellets by Mahalanobis distance for each pellet, defined as:

$$M(k) \stackrel{\text{def}}{=} \|k-\mu_u\|_{\Sigma_u}=\sqrt{(k-\mu_u)^H\Sigma_u^{-1}(k-\mu_u)}, \tag{41}$$

discarding all pellets with distance larger than a threshold (e.g. 0.95 equiprobability curve of $k_1$), and finally returning the K shortest ones, where K is a practical upper limit for the amount of terms to be considered. The K selected pellets are denoted as $\hat{k}\in\mathcal{K}$.

With high probability, the algorithm returns a good set of phase unwrappings; the likelihood that a pellet ends up in the Euclidean Voronoi region of a lattice point is similar to the likelihood of the lattice point itself.

TABLE 1

Notation.

| Notation | Meaning |
|---|---|
| a~f(a) | a has probability density function f(a) |
| a~f(a) | a approximately has probability density function f(a) |
| p(a) | Probability density function of a |
| $\odot$ | Elementwise (Hadamard) product |
| \|a\| | Elementwise absolute value |
| <a | Elementwise argument |
| a\|b | Random variable a, given a realization of b |

TABLE 2

Input parameters
Known (input) parameters

| Symbol | Domain | Meaning | Unit |
|---|---|---|---|
| N | $\mathbb{Z}$ | Number of sensors | — |
| $\sigma$ | $\mathbb{R}^+$ | Sensor noise floor | Pa |
| $\mu_s$ | $\mathbb{C}$ | Expected signal from the source | — |
| $\Sigma_s$ | $\mathbb{C}$ | Uncertainty (variance) in signal from the source | — |
| $\mu_w$ | $\mathbb{C}^N$ | Nominal waveguide transfer functions | — |
| $\Sigma_w$ | $\mathbb{C}^{N\times N}$ | Uncertainty and correlations in waveguide transfer functions | — |
| $\mu_x$ | $\mathbb{C}^N$ | Nominal sensor gain ($\Re$) and phase ($\Im$) before calibration | — |
| $\Sigma_x$ | $\mathbb{C}^{N\times N}$ | Tolerances in sensor gain ($\Re$) and phase ($\Im$) before calibration | — |

TABLE 3

Output parameters
Unknown (output) parameters

| Symbol | Domain | Meaning | Unit |
|---|---|---|---|
| $\mu_c$ | $\mathbb{R}^N$ | Nominal sensor gain ($\Re$) and phase ($\Im$) after calibration | — |
| $\Sigma_c$ | $\mathbb{C}^{N\times N}$ | Tolerances in sensor gain ($\Re$) and phase ($\Im$) after calibration | — |

TABLE 4

| Intermediate variables for the regression<br>Intermediate variables (regression) | | | |
|---|---|---|---|
| Symbol | Domain | Meaning | Unit |
| $\mu_m$ | $\mathbb{R}$ | Intermediate mean in approximation of observation gain | Pa |
| $\mu_g$ | $\mathbb{R}^N$ | Mean of log-normal approximation of observation gain | — |
| $\sigma_g$ | $\mathbb{R}$ | Std. dev. of log-normal approximation of observation gain | — |
| $\sigma_p$ | $\mathbb{R}$ | Std. dev. of log-normal approximation of observation phase | — |
| $\mu_t$ | $\mathbb{C}^N$ | Mean of source-waveguide product | — |
| $\Sigma_t$ | $\mathbb{C}^{N\times N}$ | Covariance of source-waveguide product | — |
| Z, $Z_k$ | $\mathbb{R}$ | Unimportant normalization constants | — |
| $\Im\,\bar{u}_c(\hat{k})$ | $\mathbb{R}^N$ | Nominal phase after calibration for specific phase unwrapping | — |
| $\Im\,\bar{\Sigma}_c$ | $\mathbb{R}^{N\times N}$ | Tolerances in phase after calibration for specific unwrapping | — |

TABLE 5

| Intermediate variables for the phase unwrapping<br>Intermediate variables (phase unwrapping) | | | |
|---|---|---|---|
| Symbol | Domain | Meaning | Unit |
| k | $\mathbb{Z}^N$ | Phase ambiguity | — |
| $\hat{k}$ | $\mathcal{K}$ | Resolved phase ambiguity | — |
| $\mu_u$ | $\mathbb{R}^N$ | Mean for shotgun unwrapping | — |
| $\Sigma_u$ | $\mathbb{R}^{N\times N}$ | Covariance for shotgun unwrapping | — |
| $k_1$ | $\mathbb{R}^N$ | Continuous phase ambiguity for shotgun unwrapping | — |
| $\mathcal{K}_1$ | $\{\mathbb{R}^N\}^{K_1}$ | The set of $K_1 \in Z_+$ samples from $k_1$ | — |
| $\mathcal{K}_2$ | $\{\mathbb{Z}^N\}^{K_2}$ | The set of $K_2 \in Z_+ \leq K_1$ unique and rounded samples from $\mathcal{K}_1$ | — |
| $\mathcal{K}$ | $\{\mathbb{Z}^N\}^{K}$ | The set of $K \in Z_+ \leq K_2$ most dominant samples from $\mathcal{K}_2$ | — |

TABLE 6

| Unobserved random variables<br>Unobserved (latent) random variables | | | |
|---|---|---|---|
| Symbol | Domain | Meaning | Unit |
| x | $\mathbb{C}^N$ | Calibration state | — |
| s | $\mathbb{C}$ | Source signal | Pa |
| w | $\mathbb{C}^N$ | Waveguide transfer functions | — |
| t | $\mathbb{C}^N$ | Product of source signal and waveguide transfer functions | Pa<br>— |

TABLE 7

| Observed random variables<br>Observed (measured) random variables | | | |
|---|---|---|---|
| Symbol | Domain | Meaning | Unit |
| o | $\mathbb{C}^N$ | Observation | Pa |

The invention claimed is:

1. A method of calibrating gains and/or phases of elements of an array of N acoustic microphones, the method comprising:

providing an acoustic source;

providing an estimate of a transfer function from the acoustic source to the elements of the array of N acoustic microphones;

performing one or more measurements of acoustic signals received at the elements of the array of N acoustic microphones when the acoustic source is operating;

performing Bayesian inference of gains and/or phases of the array of N acoustic microphones based at least on the one or more measurements and on the estimate of the transfer function.

2. The method of claim 1, wherein a posterior phase probability distribution of the Bayesian inference is an infinite weighted sum of normal distributions, each normal distribution having a corresponding weight γ(k), where k is an N-dimensional vector of integers;

wherein a phase unwrapping of the Bayesian inference is performed by sampling a probability distribution of γ(k) to provide a k-set and selecting the K best values from the k-set, wherein K is a predetermined integer.

3. The method of claim 2, wherein sampling a probability distribution of the weights γ(k) to provide a k-set and selecting the K best values from the k-set comprises:

sampling from a continuous probability distribution of γ(k) to provide an initial k-set $\mathcal{K}_1$;

rounding elements of the initial k-set $\mathcal{K}_1$ to the nearest integers and eliminating any resulting duplicates to provide a discretized k-set $\mathcal{K}_2$;

evaluating distances of each element of $\mathcal{K}_2$ from a mean of the probability distribution of γ(k);

selecting the K elements of $\mathcal{K}_2$ having the shortest distances as the K best values.

4. The method of claim 3 wherein the selecting the K elements of $\mathcal{K}_2$ having the shortest distances comprises removing elements of $\mathcal{K}_2$ having distances greater than a predetermined threshold prior to selecting the K best weights.

5. The method of claim 3, wherein the probability distribution of γ(k) has a mean $\mu_u$ and a covariance matrix $\Sigma_u$, and wherein the evaluating distances M(k) comprises calculating $M(k) = \sqrt{(k-\mu_u)^H \Sigma_u^{-1} (k-\mu_u)}$ .

6. The method of claim 1, wherein amplitude and/or phase of the acoustic source are assumed to be drawn from a predetermined source probability distribution.

7. The method of claim 1, wherein the transfer functions are determined by an acoustic waveguide network configured to couple the acoustic source to the array of acoustic microphones.

8. The method of claim 7, wherein the acoustic waveguide network includes a source port corresponding to the acoustic source, and array ports, each array port corresponding to a corresponding one of the elements of the array of acoustic microphones.

9. The method of claim 1, wherein the acoustic source is an uncalibrated acoustic source.

10. The method of claim 9, wherein the acoustic source is part of a mobile electronic device.

11. The method of claim 1, wherein the acoustic source comprises an acoustic calibrator or pistonphone.

12. The method of claim 1, further comprising using an auxiliary reference microphone to provide a traceable calibration of the array of N acoustic microphones.

13. The method of claim 1, wherein the Bayesian inference is further based on informative prior estimates of gains and/or phases of the array of N acoustic microphones.

14. The method of claim 13, wherein the informative prior estimates of gains and/or phases of the array of N acoustic microphones are derived from manufacturer specifications of the array of N acoustic microphones.

* * * * *